United States Patent [19]

Lehman

[11] 4,059,089

[45] Nov. 22, 1977

[54] FLYING SAUCER LAUNCHING PISTOL

[75] Inventor: James A. Lehman, El Cajon, Calif.

[73] Assignee: Warner-Lehman Corporation, El Cajon, Calif.

[21] Appl. No.: 722,707

[22] Filed: Sept. 13, 1976

[51] Int. Cl.[2] ..... F41B 7/00

[52] U.S. Cl. ..... 124/27; 124/83; 124/41 R; 42/76 R

[58] Field of Search ..... 124/27, 28, 29, 37, 124/41 R, 42, 49, 83, 21, 46, 47; 42/76 R, 78, 54, 55

[56] References Cited

U.S. PATENT DOCUMENTS

| | | | |
|---|---|---|---|
| 1,845,703 | 2/1932 | Feild | 42/55 |
| 3,204,627 | 9/1965 | Yano | 124/37 X |
| 3,734,075 | 5/1973 | Staples | 124/49 X |
| 3,859,977 | 1/1975 | Lange | 124/27 X |

*Primary Examiner*—Richard C. Pinkham
*Assistant Examiner*—William R. Browne
*Attorney, Agent, or Firm*—Frank D. Gilliam

[57] ABSTRACT

The invention is a pistol designed to fire inverted concave disks which are smaller in size but similar in principle to the flying saucers popularized under the trademark, Frisbee. The pistol is characterized by a generally rectangular firing chamber into which the disks are individually loaded, there being a spring loaded plunger which is trigger operated to strike the disks off center to impart a spinning as well as translational movement to them, and a rib at the exit end of the firing chamber retards one side of the existing disk to accelerate the spin. The rear end of the firing chamber beneath the loading opening is provided in its lower side edges with a pair of doubly inclined ramps which define centering surfaces so that the loaded disk will automatically settle into a laterally central position, and an upright post connected to the trigger projects into the hollowed area of the disk from beneath to restrain same in firing position, the post moving clear of the disk simultaneously with the firing action initiated by drawing the trigger rearwardly.

7 Claims, 8 Drawing Figures

FLYING SAUCER LAUNCHING PISTOL

BACKGROUND OF THE INVENTION

The invention is a toy pistol which is a modification and an improvement upon a Bottle Cap Pistol developed by the inventor and for which a patent is co-pending having Ser. No. 615,567 filed Sept. 22, 1975 now U.S. Pat. No. 4,016,854. The Bottle Cap Pistol is very similar to the present invention, especially insofar as the ejecting plunger which strikes the projectile off center and a spin agumenting rib at the firing chamber exit are concerned. Certain problems inherent in the somewhat irregularly shaped bottle caps were discovered and resolved by the use in the present invention of specially made inverted concave disks generally similar in overall shape to the Bottle Caps but more uniform. In addition the relation of the Bottle Cap to the firing chamber of the Bottle Cap Pistol is such that the lateral positioning of the bottle cap could vary from one shot to the next which would affect the way in which the plunger struck the bottle cap and thus the trajectory.

SUMMARY OF THE INVENTION

The pistol of the present invention is adapted from the Bottle Cap Pistol and utilizes a novel centering structure in the firing chamber. Centering is a problem in the present invention and the Bottle Cap Pistol whereas such is not the case in conventional pistols because, inasmuch as the projectile must necessarily spin about a vertical axis as it is ejected, it is not practical that the projectile fit flushly within the chamber. Thus lateral play must be provided and with lateral play is associated the difficulty of lack of uniformity in the positions struck on sequentially fired disks.

Thus the present invention is provided with doubly inclined ramps in the bottom side edges of the rear portion of the firing chamber, these ramps defining surfaces which rise and move centerally from the front to the rear of the firing chamber. The disk loading opening is immediately above the area of the firing chamber having the ramps so that a disk dropped through the opening will fall on the ramps and as it settles it will automatically become centered between the sidewalls of the firing chamber. After the opening is recovered subsequent to loading, the disk may be made snug in the firing chamber by tilting the muzzle upwardly, although a rearwardly faked upwardly projecting retaining post extends into the cavity of the disk to prevent the unintended departure thereof through the muzzle, this post extending from the trigger structure so that it is moved clear of the disk as the gun is fired.

DETAILED DESCRIPTION OF THE PREFERRED EMBODIMENTS

Figures 1, 2, 3, 4:
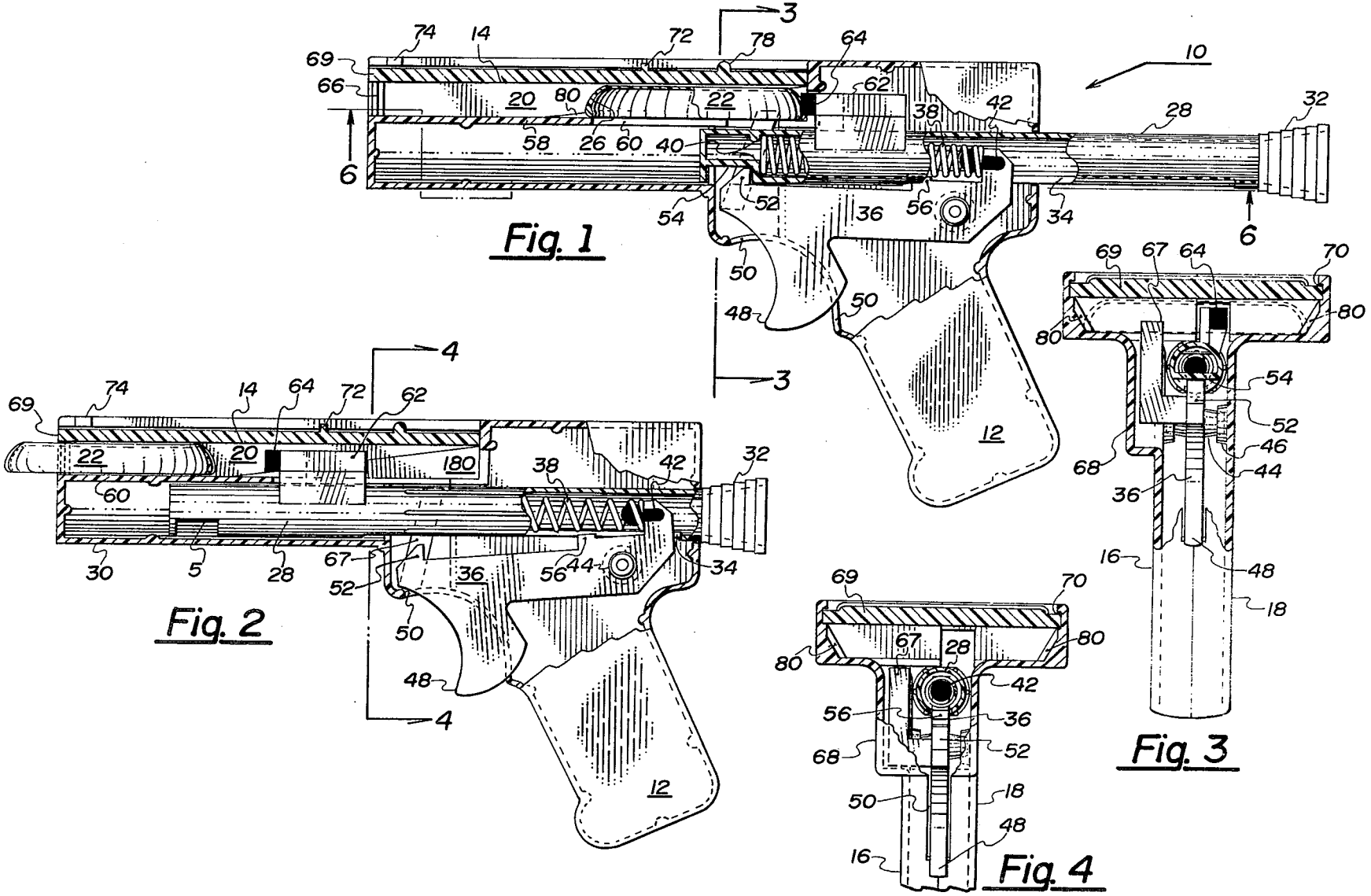
FIG. 1 is a side elevation view, with portions cut away, showing the gun loaded and cocked and ready for firing.
FIG. 2 is a similar side elevation view of the gun in a fired position.
FIG. 3 is a sectional view taken along line 3—3 of FIG. 1.
FIG. 4 is a sectional view taken along line 4—4 of FIG. 2.

The pistol has a body generally indicated at 10 with a handle 12 and a barrel or muzzle 14. The body is formed in conventional fashion of two mating halves 16 and 18 which would normally be molded in plastic. In contrast to conventional barrels, the instant invention utilizes a barrel which defines a firing chamber 20 which is rectangular both in plan form and in transverse cross section. The rectangular firing chamber accommodates the projectile 22 which is in inverted disk concave on the underside and having a flat top wall 24 and downwardly curved annular wall 26 so that the projectile is similar in shape to a "Frisbee", although much smaller.

The propulsive force is delivered by a hollow plastic plunger 28 which extends through an opening in the rear wall of the pistol and is guided at its front end by a cylindrical sleeve 30, which is a molded extension of the barrel 14. The plunger has an enlarged end grip 32 which prevents penetration of the plunger too far into the pistol, but within this and certain other limits the plunger is free to slide longitudinally in the pistol.

The bottom surface of the plunger has an elongated rectangular opening 34 through which an extension of trigger means 36 extends, and a compressed coil spring 38 is disposed in a forward portion of the plunger and exerts an expansive force against shoulder elements 40 and the trigger extension which engages the rear end of the spring by means of an insert plug 42. It will be seen that the single spring 38 provides both the propulsive force for ejecting the disk 22 and the return force to the trigger 36 which is pivoted on a barrel-shaped axle 44 between a pair of bearing cups 46 molded in the sidewalls of the pistol as shown in FIG. 4.

The trigger means 36 includes a trigger tab 48 which extends through an opening 50 molded in the front of the gun's handle and a catch 52 extends upwardly from a front portion of the trigger assembly to engage an inverted notch 54 in the front of the plunger to retain the plunger in the cocked position. The catch 52 has a sloped forward edge so that the catch will ride over the forward edge of the opening 34 as the plunger is cocked, and the catch snaps into place in the notch 54 when the plunger is drawn back to the proper cocked position. The trigger mechanism also has a shoulder 56 against which the front edge of the opening 34 abutts to prevent the plunger from being drawn free of the remainder of the pistol entirely.

The firing chamber 20 has a flat floor 58 with a elongated opening 60 which is necessary to admit a chuck 62 which carries a firing pin or tip 64 composed of elastomoric or rubbery material to engage the side of the projectile 22 for ejecting same. As can best be seen in FIG. 3, the firing pin 64 is positioned off center relative to the projectile so that rotational motion is imparted to the disk as well as translatory force.

The operation of the pistol as thus far described should be obvious from the mechanical description. To cock the gun, the plunger is manually withdrawn from the position of FIG. 2 to the position of FIG. 1 at which point the catch 52 engages the rear edge of the cocking notch 54 so that the plunger is stable in the cocked mode. This clears the chuck 62 from the firing chamber so that a disk may be loaded, subsequent to which the gun is of course fired by pulling the trigger releasing the plunger to snap forward and eject the projectile with the firing pin 64.

As the projectile exits the firing chamber it strikes a rib 66 which has been incorporated on the other side of the firing chamber from the firing tip 64. The purpose of the rib is to engage and retard one side of the disk so that the spin initally imparted to the disk will be augmented. The disk would normally be on the side of the firing chamber which has the rib because it is struck eccentrically on the opposite side by the firing pin.

A rearwardly slanted post 6 which extends upwardly from the trigger assembly also passes through an opening in the firing chamber floor and into the chamber to fall within the concave under portion of the projectile. As the trigger is pulled, the post draws away to free the disk for firing and as the trigger is returned, the post is effective to retain the disk in a rearward position in the firing chamber.

The half 16 of the body of the pistol is provided with an enlarged portion 68 as is best seen in FIGS. 3 and 4, the purpose of this enlargement being to accommodate the post 67 which must extend a fair distance from the trigger means in order to avoid the plunger 28.

Figure 5:
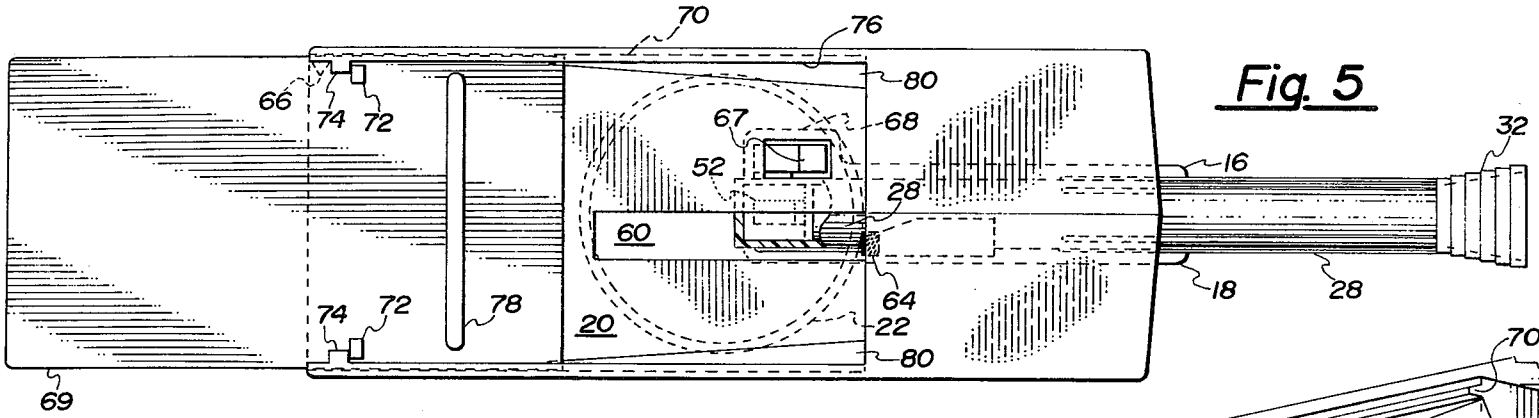
FIG. 5 is a top plan view of the gun with the sliding cover open for loading.

In order to load the projectiles into the firing chamber a cover slide 69 is used to constitute the top of the firing chamber and slides within channels 70 defined in the sidewalls of the chamber and is limited by means of stops 72 which abutt shoulders 74 projecting from the sidewalls of the gun barrel to prevent the complete separation of the slide from the gun. As can be seen in FIG. 5, when the slide is manually pulled forwardly an opening 76 is made through which a disk may be inserted. The slide has a lateral rib grip 78 so that the user may easily draw the slide back and forth for loading.

The lateral width of the firing chamber is of necessity larger than that of the disks 22 which are fired there through so that the appropriate spinning moment may be imparted to the disk. Thus to eliminate the problem of descrepancies in lateral positioning of the disk which would cause erratic firing due to the varied eccentricity of the pin 64 relative to the disk, a pair of ramps 80, which are in fact simply molded into the gun barrel, are used in the back rear lower edges of the firing chamber. These ramps are best illustrated in FIGS. 5 through 8 and are characterized by a double slope, the slope being downward toward the front of the gun and downward toward the center of the firing chamber.

Figure 7:
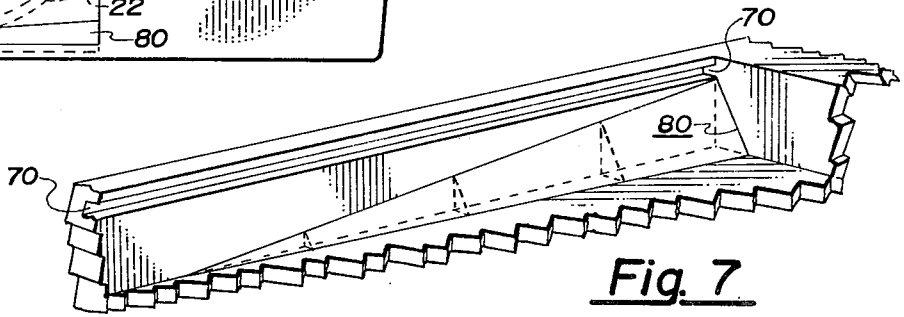
FIG. 7 is a fragmentary view of one of the lower rear corners of the firing chamber illustrating a ramp and showing in dotted line the configuration of the firing chamber without the ramp.
Figure 8:
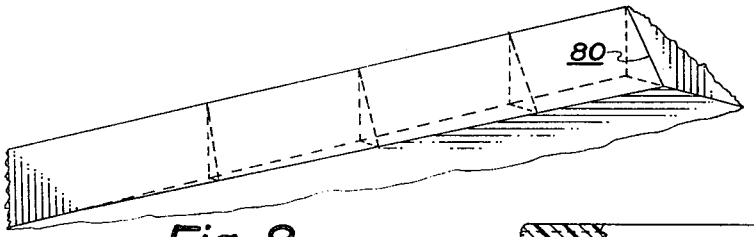
FIG. 8 is a fragmentary view similar to FIG. 7 illustrating a variation of the ramp structure.
Figure 6:
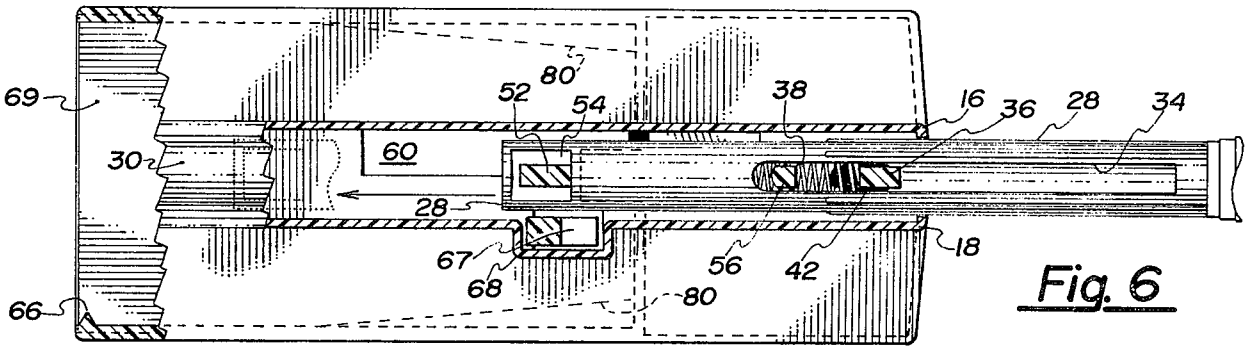
FIG. 6 is a sectional view taken on the line 6—6 of FIG. 1.

Two types of ramps are used, the first illustrated in FIG. 7 comprising a pyramid and having an even downward slant, both forward and toward the center. The surface defined by these pyramids will of course be planar. A second type of ramp shown in FIG. 8 is not pyramidal but rather is the same height throughout its entire length, the bases of the cross sectional triangles becoming smaller toward the front. However, the ramp of FIG. 8 still provides a double incline, although the surface defined is not planar but slightly twisted longitudinally.

When a projectile is dropped into the firing chamber as is shown by the dotted concentric circular lines in FIG. 5, the ramps will cause it to center itself between the sidewalls of the firing chamber. Ordinarily the disk would move forwardly until its diameter across the bottom is equal to the space between the bottom edges of the ramps so that the disk lies flat on the floor 58 of the firing chamber as is illustrated in FIG. 1. However, by raising the muzzle upwardly at an angle obviously the disk would migrate rearwardly, but would still be centered between the sidewalls which is of course what is intended.

The use of the ramps as shown has an additional advantage in that slight variations in the diameter of the disks used as projectiles will not interfer with the operation of the pistol, but would be centered equally well regardless of slight variations.

The pistol as thus described provides an entertaining and inexpensive toy and combines the entertainment values inherent in the use of simulated weapons with that of the popular "Frisbee" type flying saucers. The unit is clearly simple to operate and virtually foolproof and jamproof.

I claim:

1. A pistol for firing concave disks comprising:
   a. a body having a handle and a barrel defining a firing chamber.
   b. a spring-loaded plunger in said body operable throughout a firing stroke to eject an inverted concave disk positioned in said firing chamber;
   c. trigger means mounted to said body operable to selectively restrain said plunger in a cocked position and release said plunger to eject a disk;
   d. said firing chamber being generally rectangular in transverse cross section and having structure defining ramps in the rear lower edges thereof, said ramps having surfaces which are diagonal in cross section relative to said rectangular firing chamber and progressively incroach on the volume of said firing chamber toward the rear such that an inverted concave disk dropped into said chamber will be self centering between said ramps under the action of gravity.

2. Structure according to claim 1 wherein said ramps are pyramidal and each defines a planar surface exposed in said chamber.

3. Structure according to claim 1 wherein said ramps are triangular in cross section and the triangles of cross sections from front to rear are of equal height but of progressively longer base width such that the surfaces defined by the ramps are complex and are directed increasingly upwardly toward to the rear of said firing chamber.

4. Structure according to claim 1 wherein said trigger means is pivotally connected to said body and an upwardly directed stop post extends into said firing chamber from said trigger to engage the hollowed underside of an inverted concave disk to prevent the accidental existing thereof, said post moving free of said firing chamber with said trigger means as the latter is moved to the firing position.

5. Structure according to claim 4 wherein said post is rearedly canted from the vertical such that upon returning said trigger to a neutral position said post urges an inverted concave disk in said firing chamber rearwardly.

6. Structure according to claim 1 wherein said barrel has a loading opening disposed above the portion of the firing chamber having the ramps therein such that inverted concave disks can be individually loaded directly onto the ramps from above.

7. Structure according to claim 6 wherein said loading opening has a cover which when in place defines a flat interior surface parallel to the floor of said firing chamber such that a disk rearwardly disposed on said ramps and thus elevated against said cover will be urged into parellelism with said cover and the floor of the firing chamber.

* * * * *